US009067418B2

(12) United States Patent
Wanibe et al.

(10) Patent No.: US 9,067,418 B2
(45) **Date of Patent: *Jun. 30, 2015**

(54) IMAGE RECORDING DEVICE

(71) Applicant: SEIKO EPSON CORPORATION, Tokyo (JP)

(72) Inventors: Akihisa Wanibe, Nagano (JP); Naoyuki Okumura, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/557,590

(22) Filed: Dec. 2, 2014

(65) Prior Publication Data

US 2015/0085011 A1 Mar. 26, 2015

Related U.S. Application Data

(63) Continuation-in-part of application No. 14/082,886, filed on Nov. 18, 2013, now Pat. No. 8,926,064.

(30) Foreign Application Priority Data

Dec. 11, 2012 (JP) ..... 2012-270080

(51) Int. Cl.
*B41J 23/00* (2006.01)
*B41J 2/165* (2006.01)

(52) U.S. Cl.
CPC ..... *B41J 2/16585* (2013.01)

(58) Field of Classification Search
CPC ..... B41J 25/308; B41J 11/42; B41J 2/0057; B41J 25/304; B41J 25/3082; B41J 29/00; B41J 2/16517
USPC ..... 347/2, 8, 16, 37, 38, 101, 104
See application file for complete search history.

(56) References Cited

U.S. PATENT DOCUMENTS

| | | | | |
|---|---|---|---|---|
| 6,250,731 | B1 | 6/2001 | Hashimoto | |
| 8,926,064 | B2 * | 1/2015 | Wanibe et al. | 347/38 |
| 2011/0149003 | A1 | 6/2011 | Kondo | |

FOREIGN PATENT DOCUMENTS

| | | |
|---|---|---|
| JP | 2004-142365 A | 5/2004 |
| JP | 2011-131435 A | 7/2011 |

* cited by examiner

*Primary Examiner* — An Do
(74) *Attorney, Agent, or Firm* — Global IP Counselors, LLP

(57) ABSTRACT

An image recording device includes a support member, a print head, a guide mechanism and a maintenance unit. The print head is configured to eject a liquid from a nozzle at a first position facing the support member. The guide mechanism is configured to guide movement of the print head among the first position, a second position, and a third position. The maintenance unit is configured to carry out maintenance on the print head which is located at the second position, the maintenance unit being arranged at a position facing the print head which is located at the second position. The third position is a position farther than the second position with respect to the first position in a direction going from the support member toward the maintenance unit in the orthogonal direction.

14 Claims, 7 Drawing Sheets

IMAGE RECORDING DEVICE

CROSS-REFERENCE TO RELATED APPLICATIONS

This is a continuation application of U.S. patent application Ser. No. 14/082,886 filed on Nov. 18, 2013, now U.S. Pat. No. 8,926,064. This application claims priority to Japanese Patent Application No. 2012-270080 filed on Dec. 11, 2012. The entire disclosures of U.S. patent application Ser. No. 14/082,886 and Japanese Patent Application No. 2012-270080 are hereby incorporated herein by reference.

BACKGROUND

1. Technical Field

The present invention relates to a technique for a maintenance unit to implement maintenance or for a worker to implement a manual task on a print head for ejecting a liquid and recording an image.

2. Background Technology

A well-known image recording device, as with an inkjet printer, forms an image on a recording medium by ejecting a liquid from nozzles on a print head while orienting the print head to face a support member on which the recording medium is being supported. Generally, in such an image recording device, a maintenance unit can be used to implement maintenance, such as for removing a clogging of the nozzles, on the print head. In addition to maintenance by a maintenance unit, a worker will also often be able to implement a manual task on the print head.

More specifically, in the image recording device of Patent Document 1, an inkjet head faces a guide plate and records an image by ejecting an ink onto a recording paper on the guide plate; in turn, the maintenance unit carries out maintenance and a worker carries out a manual task by pulling the inkjet head out to a position apart from position facing the guide plate. That is to say, at a position where the inkjet head is separated from the position facing the guide plate, a state in which maintenance can be implemented is adopted when a maintenance unit is attached to the facing position of the inkjet head, and a state allowing for a manual task is adopted when an open space is ensured in the facing position of the inkjet head without attachment of the maintenance unit.

In the image recording device of Patent Document 2, image recording involves a head unit facing a drum and ejecting an ink onto a recording medium that is on the drum. Implementing maintenance, in turn, involves separating the head unit from the drum in the radial direction while still maintaining the state where the head unit and drum face each other, and inserting a maintenance unit between the head unit and the drum and therein causing the maintenance unit to face the head unit. For a worker to carry out a manual task involves pulling the head unit out to a position apart from the position of facing the drum, and ensuring open space for a facing position of the head unit.

Thus, in the image recording devices of Patent Documents 1 and 2, the configurations allow for the adoption of an image recording state in which a print head (inkjet head, head unit) faces a support member (guide plate, drum) on which a recording medium is being supported and records an image, a maintenance state in which the print head faces a maintenance unit and undergoes maintenance, and a manual task state in which an open space is ensured at a facing position of the print head to allow for a manual task to be done.

Japanese Laid-open Patent Publication No. 2004-142365 (Patent Document 1) and Japanese Laid-open Patent Publication No. 2011-131435 (Patent Document 2) are examples of the related art.

SUMMARY

Nonetheless, the image recording devices of Patent Documents 1 and 2 have suffered problems in terms of operability when a switch is made between the maintenance state and another state (the image recording state and the manual task state). More specifically, in order to switch to the maintenance state in the image recording device of Patent Document 1, the maintenance unit is attached so as to face the print head in a state where the print head has been pulled out to the position apart from the position facing the support member. That is to say, the manual task state in which an open space exists is adopted at the facing position of the print head only when the print head is at a position separated from the position facing the support member, and therefore the maintenance unit must be moved considerably as far as the facing position of the print head. Similarly, switching from the maintenance state to another state requires removing and considerably moving the maintenance unit in order to withdraw the maintenance unit from the facing position of the print head, and time and effort are required of the worker. In the image recording device of Patent Document 2, the state where the print head faces the support member is also adopted in the maintenance state as well, and therefore causing the print head to face the maintenance unit to arrive at the maintenance state requires inserting the maintenance unit in between the print head and the support member. That is to say, the maintenance unit needs to be moved considerably as fair as the facing position of the print head (between the print head and the support member) in the image recording state. Similarly, switching from the maintenance state to another state requires withdrawing the maintenance unit from the facing position of the print head, and a comparatively elaborate drive mechanism for driving the maintenance unit is required.

Thus, Patent Documents 1 and 2 have configurations either where the maintenance unit is moved to the facing position of the print head in the image recording state or to the facing position of the print head in the manual task state, or where the maintenance unit is withdrawn from the facing position. For this reason, time and effort by the worker and an elaborate drive mechanism have been needed in order to considerably move the maintenance unit.

The invention has been achieved in view of the above problems, and an advantage thereof is to provide the feature of an image recording device able to adopt an image recording state for recording an image, a maintenance state for a maintenance unit to carry out maintenance on a print head, and a manual task state where a manual task is carried out on the print head, wherein a switch can be readily made between the maintenance state and another state without having to considerably move the maintenance unit.

An image recording device according to one aspect includes a support member, a print head, a guide mechanism and a maintenance unit. The support member is configured to support a recording medium being conveyed in a conveyance direction. The print head is configured to eject a liquid from a nozzle at a first position facing the support member so as to record an image on the recording medium which is located on the support member. The guide mechanism is configured to guide movement of the print head among the first position, a second position which is different from the first position, and a third position which is different from the first position and the second position in an orthogonal direction orthogonal to a facing direction in which the print head at the first position and the support member face each other. The maintenance unit is configured to carry out maintenance on the print head which is located at the second position, the maintenance unit being arranged at a position facing the print head which is located at the second position. The third position is a position farther than the second position with respect to the first position in a direction going from the support member toward the maintenance unit in the orthogonal direction.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
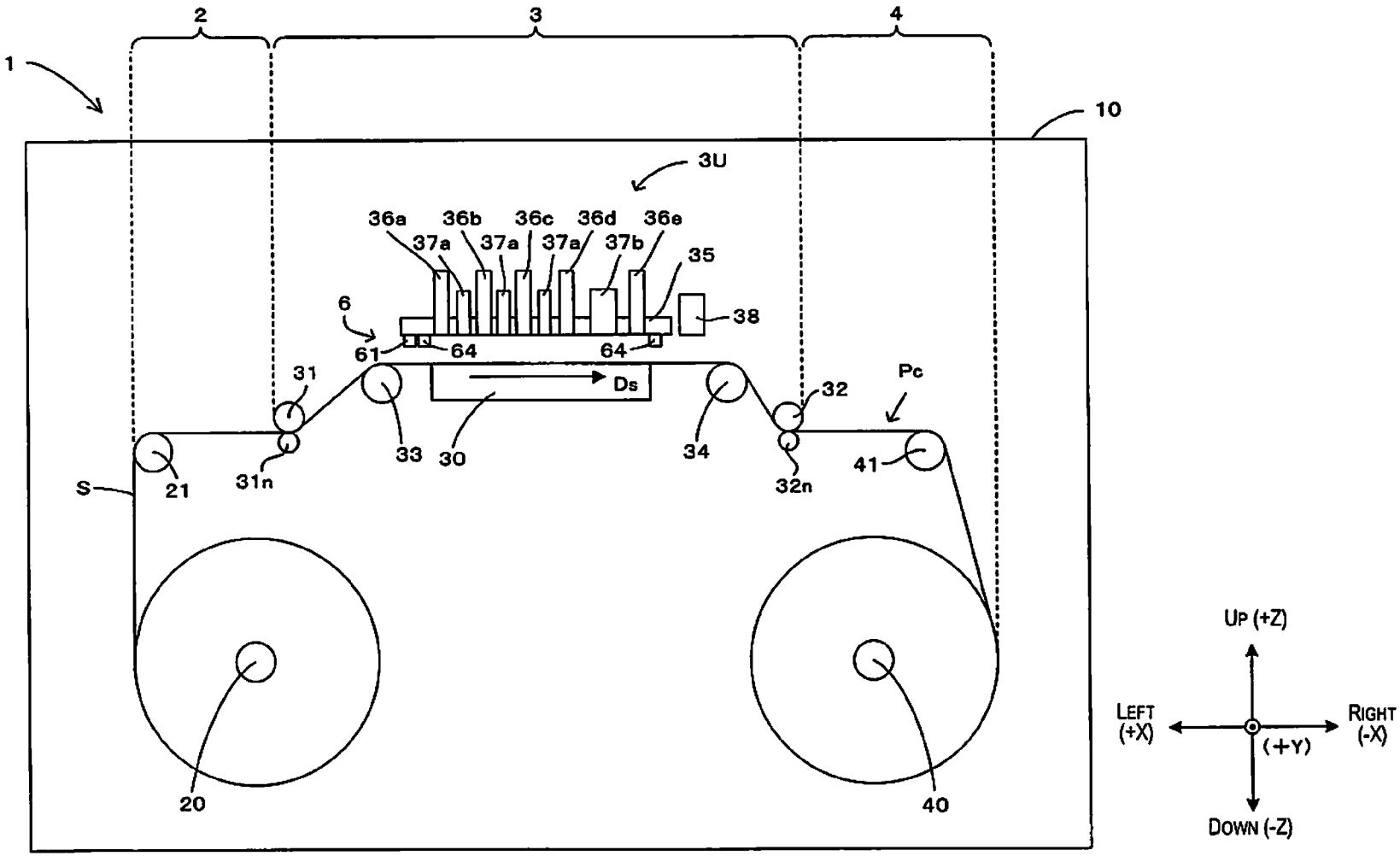
FIG. 1 is a front view schematically illustrating a first embodiment of an image recording device as in the invention.

The first embodiment of the image recording device as in the invention shall be described below, with reference to the accompanying drawings. FIG. 1 is a front view schematically illustrating the first embodiment of the image recording device as in the invention. In FIG. 1 and subsequent drawings, in order to clarify the relationships of arrangement among the various sections of the device as needed, a three-dimensional coordinate system corresponding to a left-right direction X, front-rear direction Y, and vertical direction Z of an image recording device 1 shall be employed.

As illustrated in FIG. 1, in the image recording device 1, a feed-out section 2, a process section 3, and a take-up section 4 are arrayed in the left-right direction, and an outer casing member 10 accommodates these function sections 2, 3, and 4. The feed-out section 2 and the take-up section include a feed-out spindle 20 and a take-up spindle 40, respectively. The two ends of a sheet S (a webbing) are wrapped in the shape of a roll around the feed-out section 2 and the take-up section 4, and span therebetween. Along a conveyance path Pc spanning in this manner, the sheet S is conveyed from the feed-out spindle 20 to the process section 3, subjected to an image recording process by a head unit 3U, and thereafter conveyed toward the take-up spindle 40. The types of sheet S, which is equivalent to the "recording medium" of the invention, are broadly classified into paper-based and film-based. As specific examples, paper-based includes high-quality paper, cast paper, art paper, coated paper, and the like, while film-based includes synthetic paper, PET (polyethylene terephthalate), PP (polypropylene), and the like. In the following description, whichever side of the two sides of the sheet S is the one on which the image is recorded is referred to as the "front surface", while the side opposite thereto is referred to as the "back surface".

The feed-out section 2 has the feed-out spindle 20, around which an end of the sheet S has been wound, as well as a driven roller 21 around which is wound the sheet S having been drawn out from the feed-out spindle 20. The feed-out spindle 20 supports the end of the sheet S wound therearound in a state where the front surface of the sheet S faces outward. Clockwise rotation of the feed-out spindle 20, as seen in the plane of the paper in FIG. 1, causes the sheet S having been wound around the feed-out spindle 20 to be fed out toward the process section 3, passing by way of the driven roller 21.

The process section 3 is for recording an image onto the sheet S by carrying out, as appropriate, a process using the head unit 3U, which is arranged along the surface of a flat-shaped platen 30 (equivalent to the "support member" of the invention) configured so as to have a planar shape, while the sheet S, having been fed out from the feed-out section 2, is being supported by the platen 30. In the process section 3, a front drive roller 31 and a rear drive roller 32 are provided to both ends of the platen 30, and the sheet S, which is conveyed from the front drive roller 31 to the rear drive roller 32, is supported on the platen 30 and subjected to the printing of an image.

The front drive roller 31 has on the outer peripheral surface a plurality of minute projections formed by spraying; the sheet S, having been fed out from the feed-out section 2, is wound therearound from the front surface side. Then, the front drive roller 31 rotates in the counterclockwise direction as seen in the plane of the paper in FIG. 1, thereby conveying the sheet S that has been fed out from the feed-out section 2 toward the downstream side of the conveyance path Pc. A nip roller 31*n* is provided to the front drive roller 31. The nip roller 31*n* comes up against the back surface of the sheet S in a state of having been urged toward the front drive roller 31 side, and catches the sheet S against the front drive roller 31. This ensures the force of friction between the front drive roller 31 and the sheet S, and makes it possible for the front drive roller 31 to reliably convey the sheet S.

A support mechanism (not shown) allows the flat-shaped platen 30 to be supported so that the surface (an upper surface) that supports the sheet is horizontal. Driven rollers 33, 34 are provided to the left and right sides of the platen 30, and the driven rollers 33, 34 wind up, from the back surface side, the sheet S being conveyed from the front drive roller 31 toward the rear drive roller 32. Upper end positions of the driven rollers 33, 34 are arranged so as to be either flush with or slightly below the surface of the platen 30, configured so as to be able to maintain a state where the sheet S being conveyed from the front drive roller 31 toward the rear drive roller 32 comes up against the platen 30.

The rear drive roller 32 has on the outer peripheral surface a plurality of minute projections formed by spraying; the sheet S, having been fed out from platen 30 and passed by way of the driven roller 34, is wound therearound from the front surface side. Then, the rear drive roller 32 rotates in the counterclockwise direction as seen in the plane of the paper in FIG. 1, thereby conveying the sheet S toward the take-up section 4. A nip roller 32*n* is provided to the rear drive roller 32. The nip roller 32*n* comes up against the back surface of the sheet S in a state of having been urged toward the rear drive roller 32 side, and catches the sheet S against the rear drive roller 32. This ensures the force of friction between the rear drive roller 32 and the sheet S, and makes it possible for the rear drive roller 32 to reliably convey the sheet S.

The sheet S being conveyed from the front drive roller 31 toward the rear drive roller 32 in this manner is conveyed in a conveyance direction Ds over the platen 30 while being supported by the platen 30. Then, in the process section 3, the head unit 3U is provided in order to print a color image onto the surface of the sheet S being supported on the platen 30. More specifically, the head unit 3U includes four print heads 36*a* to 36*d*, arranged side by side from the upstream side toward the downstream side in the conveyance direction Ds. The print heads 36*a* to 36*d* correspond to yellow, cyan, magenta, and black, respectively. Each of the print heads 36*a* to 36*d* faces the surface of the sheet S supported on the platen 30, spaced apart with some clearance, and ejects the correspondingly colored ink in an inkjet format. The ejection of the inks by each of the print heads 36*a* to 36*d* onto the sheet S being conveyed along the conveyance direction Ds forms the color image on the surface of the sheet.

It should be noted that the ink used is a UV (ultraviolet) ink that is cured by being irradiated with ultraviolet rays (light) (i.e., is a photo-curable ink). Therefore, the head unit 3U includes UV lamps 37*a*, 37*b* for causing the ink to cure and be affixed to the sheet S. The execution of this curing of the ink is divided into two stages, which are temporary curing and true curing. A temporary curing UV lamp 37*a* is arranged between each of the print heads 36*a* to 36*d*. In other words, the UV lamps 37*a* are for curing (temporarily curing) the ink so as to prevent the form of the ink from collapsing, by irradiating with weak ultraviolet rays, but without totally curing the ink. A true curing UV lamp 37*b* is in turn provided to the downstream side in the conveyance direction Ds in relation to the print heads 36*a* to 36*d*. In other words, the UV lamp 37*b* is for totally curing the ink by irradiating with stronger ultraviolet rays than those of the UV lamps 37*a*. This manner of executing the temporary curing and true curing enables affixation, onto the surface of the sheet S, of the color image formed by the print heads 36*a* to 36*d*.

The head unit 3U further includes a print head 36*e* on the downstream side in the conveyance direction Ds in relation to the UV lamp 37*b*. This print head 36*e* faces the surface of the sheet S supported on the platen 30, spaced apart with some clearance, and ejects a transparent UV ink onto the surface of the sheet S in an inkjet format. In other words, a transparent ink is further ejected onto the color image that has been formed by the four differently colored print heads 36*a* to 36*d*. A UV lamp 38 is also provided, separately from the head unit 3U, to the downstream side in the conveyance direction Ds in relation to the print head 36*e*. This UV lamp 38 is for totally curing (true curing) the transparent ink ejected by the print head 36*e*, by irradiating with strong ultraviolet rays. This makes it possible to affix the transparent ink onto the surface of the sheet S.

In this manner, in the process section 3, the inks are ejected and cured as appropriate on the sheet S being supported on the platen 30, thus forming a color image that is coated with the transparent ink. The sheet S on which the color image has been formed is then conveyed toward the take-up section 4 by the rear drive roller 32.

The take-up section 4 includes the take-up spindle 40 around which the end of the sheet S is wound, and a driven roller 41 around which the sheet S being conveyed toward the take-up spindle 40 is wound. The take-up spindle 40 supports the end of the sheet S wound therearound in a state where the surface of the sheet S faces outward. Clockwise rotation of the take-up spindle 40 as seen in the plane of the paper in FIG. 1 causes the sheet S to be wound around the take-up spindle 40, passing by way of the driven roller 41.

Herein, the head unit 3U includes a head support section 35 that extends along the conveyance direction Ds and, arranged side by side in the conveyance direction Ds, the print heads 36*a* to 36*e* and the UV lamps 37*a*, 37*b* are configured so as to be detachable from the head support section 35. While mounted onto and supported by the head support section 35, the print heads 36*a* to 36*e* and the UV lamps 37*a*, 37*b* are configured so as to be able to move integrally with the head support section 35. That is to say, when the head support section 35 moves, the print heads 36*a* to 36*e* and the UV lamps 37*a*, 37*b* move along with the head support section 35. In this manner, moving the head support section 35 makes it possible to move all of the print heads 36*a* to 36*e* at once, and thus it is easier to switch to respective states to be described below (an image recording state, a maintenance state, and a manual task state).

Figure 2:
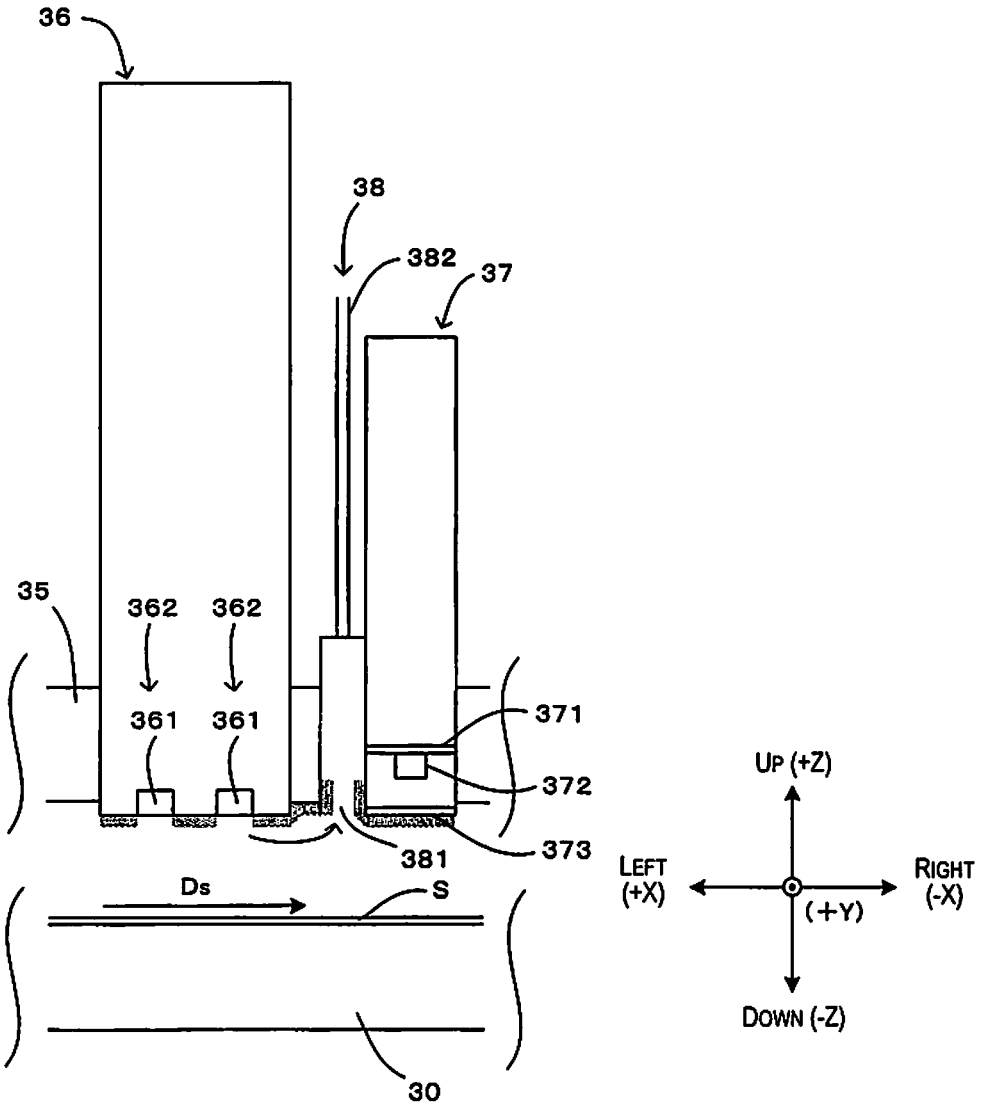
FIG. 2 is an enlarged front view providing a more detailed illustration of a print head periphery.

The description shall next relate to the configuration near the nozzles of the print heads, with reference to FIG. 2. FIG. 2 is an enlarged front view providing a detailed illustration of the periphery of a print head. Herein, the print heads 36*a* to 36*e* have fundamentally the same configuration, with the exception of having correspondingly different colors or types of inks, and the UV lamps 37*a*, 37*b* arranged between the print heads 36*a* to 36*e* also have fundamentally the same configuration. Therefore, in the description for FIG. 2 and beyond, the print heads 36*a* to 36*e* shall be denoted by a print head 36, unless otherwise noted, and the UV lamps 37*a*, 37*b* shall be denoted by a UV lamp 37 as well, also unless otherwise noted.

A plurality of nozzles 361 are provided to a surface of the print head that faces the platen 30 (a nozzle formation surface). A variety of modes can be adopted as appropriate for the arrangement of the nozzles 361, but used herein is a mode where there are a plurality of the nozzles 361 arranged side by side in the front-back direction (Y-direction), thus forming nozzle columns 362 (see FIG. 4), and there are two of the nozzle columns 362 provided in the conveyance direction Ds. The image is formed on the sheet S by the ejection of the ink, at the appropriate timing, onto the sheet S supported on the platen 30 from each of the nozzles 361.

The UV lamp 37 includes light-emitting units 372 that are disposed on a substrate 371. There are a plurality of the light-emitting units 372 arranged side by side in the front-back direction, forming columns of substantially the same length as that of the nozzle columns 362, enabling irradiation of a region in which the image is formed in the width direction of the sheet S. A surface of the UV lamp 37 that faces the platen 30 is constituted of a glass sheet 373; when the light-emitting units 372 irradiate with light, the irradiated light passes through the glass sheet 373 and is incident on the surface of the sheet S supported on the platen 30. The result is curing of the ink that has been ejected onto the surface of the sheet S by the print head 36.

Furthermore, a mist suction section 38 configured integrally with the UV lamp is provided supported by the head support section 35 between the print head 36 and the UV lamp 37 in the conveyance direction Ds. A suction port 381 of the mist suction section 38 extends so as to be of substantially the same length as that of the nozzle columns 362 in the front-back direction, and an opening surface (lower surface) of the suction port 381 is positioned at either the same position as or slightly above the nozzle formation surface of the print head 36 in the vertical direction. The suction port 381 is connected to a negative pressure generation section (not shown) via a suction hose 382, where actuating the negative pressure generation section produces a negative pressure in the suction port 381 and causes an ink mist that becomes a fine spray spreading in all directions to be suctioned into the suction port 381. So doing prevents the spreading ink mist from attaching to the sheet S or from diffusing into the device and contaminating the various parts.

The nozzle formation surface and side surfaces of the print head 36, the lower surface of the head support section 35, the lower surface of the glass sheet 373 of the UV lamp 37, an inner wall surface of the suction port 381 of the mist suction section 38, and the like (places that are shaded in FIG. 2) are susceptible to ink attaching and to this ink either dropping down or spreading and contaminating the sheet S. Moreover, as repeat usage goes on, the nozzles 361 may suffer ink clogging, which interferes with the ejection of ink. A maintenance unit may be provided in the image recording device of an inkjet format, in order to minimize such problems.

A known maintenance unit of such description is, for example, what is described in Japanese Laid-open Patent Publication No. 2012-086409, and therefore a more detailed description thereof is herein omitted, but a brief overview of a maintenance (a first maintenance) executed by the maintenance unit shall be described. Examples of processes carried out by the maintenance unit include capping, cleaning, and wiping. Capping is a process for covering the nozzles with a cap to prevent the viscosity of the ink from increasing within the nozzles. Cleaning is a process for forcibly discharging the ink from the nozzles by capping the nozzles and in this state creating a negative process in the cap. This cleaning makes it possible to remove ink of increased viscosity, bubbles in the ink, and the like from the nozzles. Wiping is a process for using a wiper to wipe the nozzle formation surface of the print head. This wiping makes it possible to wipe the ink away from the nozzle formation surface of the print head.

Such use of the maintenance unit makes it possible to wipe away ink that has attached to the nozzle formation surface of the print head 36, or to eliminate ink clogging of the nozzles 361. However, in some instances the processes using the maintenance unit fail to achieve sufficient removal of ink that has attached to the side surfaces of the print head 36, the lower surface of the head support section 35, the lower surface of the glass sheet 373 of the UV lamp 37, the inner wall surface of the suction port 381 of the mist suction section 38, and the like. In such a case, a worker needs to clean each of the parts of the head unit 3U by hand after the maintenance by the maintenance unit has been executed.

On the basis of such circumstances, the image recording device 1 as in the first embodiment is configured so as to be able to adopt an image recording state in which the print head 36 faces the platen 30 and records an image, a maintenance state in which the print head 36 faces the maintenance unit and undergoes maintenance, and a manual task state in which a manual task (a second maintenance) is carried out on the print head 36. The configuration also allows for easy switching between the maintenance state and another state, without considerably moving the maintenance unit, so that the maintenance or manual task can be carried out more efficiently. What follows is a more detailed description of this feature.

Figure 3:
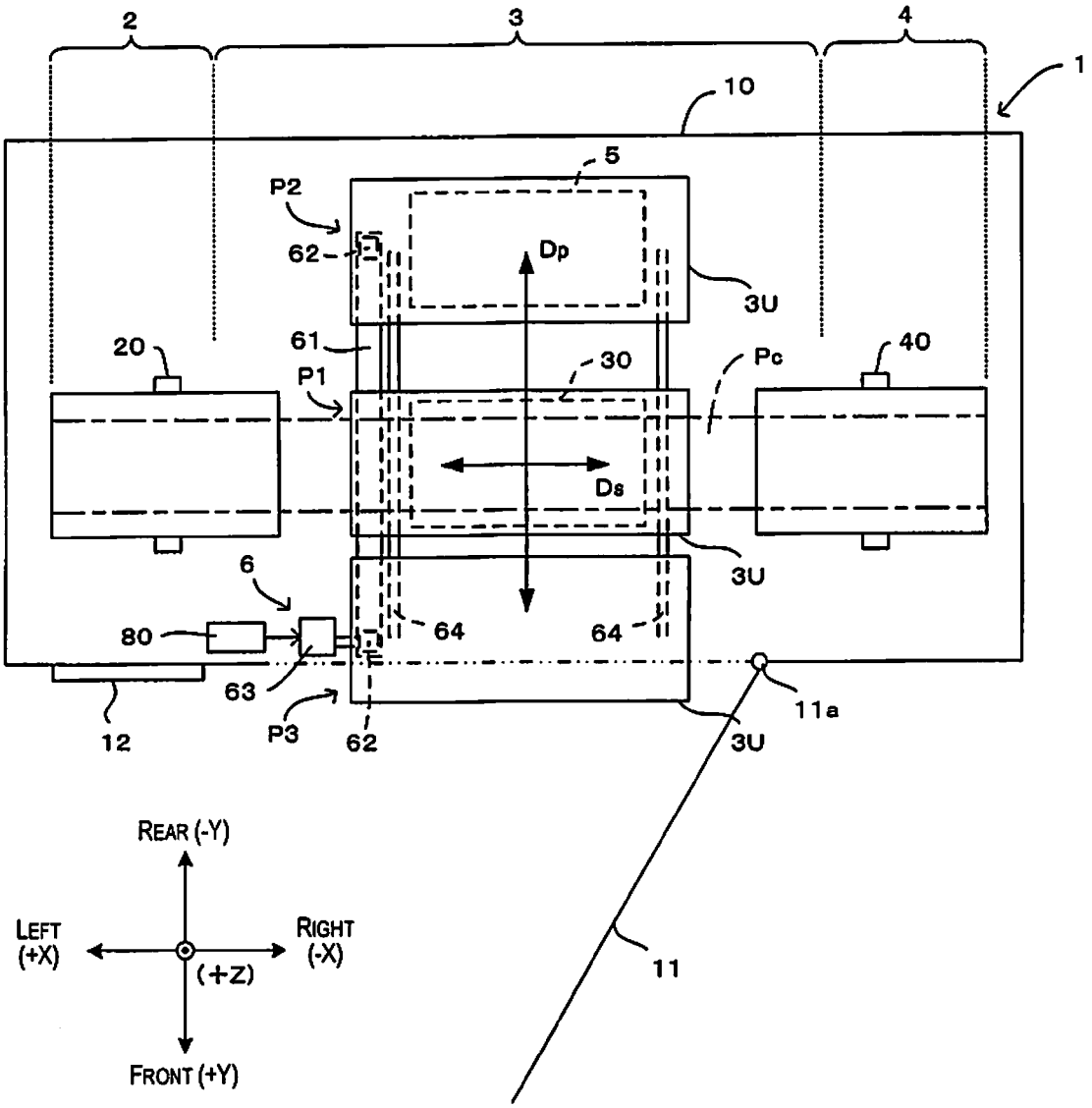
FIG. 3 is a plan view illustrating a mode of movement of a head unit in the first embodiment.
Figure 4:
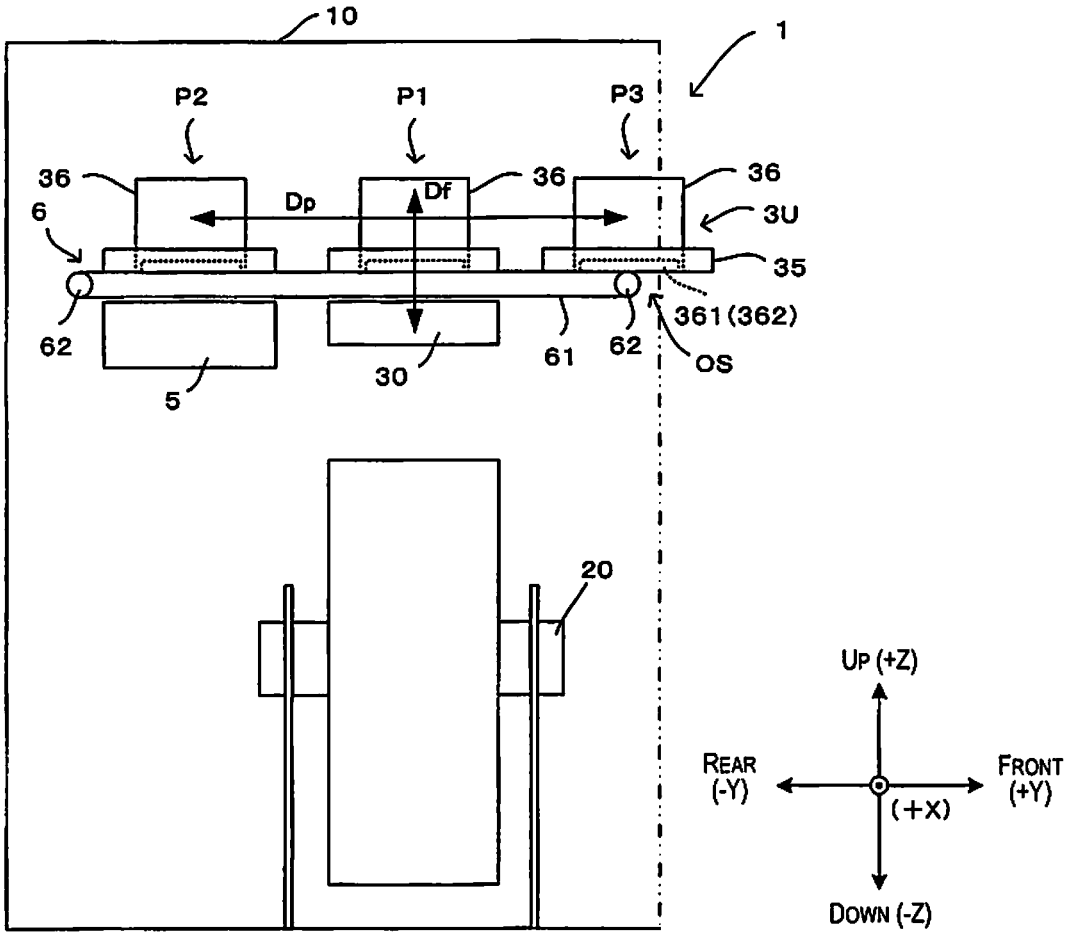
FIG. 4 is a side view illustrating a mode of movement of the head unit in the first embodiment.

FIG. 3 is a plan view illustrating a mode of movement of the head unit in the first embodiment, and FIG. 4 is a side view illustrating a mode of movement of the head unit in the first embodiment. To facilitate understanding of the description for FIGS. 3 and 4, the depiction is mainly of the positional relationships between the head unit 3U, the platen 30, and the maintenance unit 5, with other members omitted as appropriate for being described. Also, FIGS. 3 and 4 illustrate states where the head unit 3U is moved to three positions, and do not signify that there are three head units 3U provided. As illustrated in FIGS. 3 and 4, in the present embodiment, the maintenance unit 5 is disposed to the rear of the platen 30, which is arranged near a middle section of the image recording device 1. A guide mechanism 6 is provided so as to allow the head unit 3U to adopt a first position P1, a second position P2, and a third position P3 along an orthogonal direction Dp (front-back direction) that is orthogonal in plan view to the conveyance direction Ds (the left-right direction) of the sheet S.

Herein, the first position P1 refers to a position facing the platen 30, and when in the first position P1, the head unit 3U enters the image recording state in which the print head 36 faces the platen 30 and an image is recorded onto the sheet S that is on the platen 30 by the print head 36. At the first position P1, the configuration allows for the head unit 3U to move, albeit only slightly, in a direction approaching or drawing away from the platen 30, i.e., in the vertical direction. Having such a configuration makes it possible to minimize contact between the head unit 3U and the platen 30, by moving the head unit 3U in a state where there is a greater gap between the head unit 3U and the platen 30 (a separated state) than a state where the head unit 3U and the platen 30 are brought closer together to record an image (a near state).

The second position P2 refers to a position facing the maintenance unit 5, and when in the second position P2, the head unit 3U enters the maintenance state in which the print head 36 faces the maintenance unit 5 and the maintenance of the print head 36 is carried out by the maintenance unit 5. The third position P3 is located forward of the first position P1, and when the head unit 3U is in the third position P3, the whole area of the print head 36 protrudes out from the platen 30 in the orthogonal direction Dp, which is a direction going from the maintenance unit 5 toward the platen 30. That is to say, the rear end of the nozzle formation surface of the print head 36, when in the third position P3, is located forward of the front end of the platen 30, and the whole area of the print head 36 faces neither the platen 30 nor the maintenance unit 5 in the orthogonal direction Dp; therefore, a broad opening space OS (see FIG. 4) is ensured below the whole area of the print head 36 in the orthogonal direction Dp, thus entering the manual task state in which the worker can access the print head 36 and carry out the manual task from the opening space OS. In the manual task state, not only can each of the parts of the head unit 3U be cleaned by the manual task, but also tasks such as replacing the light-emitting units 372 of the UV lamp 37 or the print head 36 can also be carried out.

The guide mechanism 6, which guides the movement of the head unit 3U in the orthogonal direction Dp, is configured to include: a guide belt 61 provided extending in the orthogonal direction Dp; a pair of pulleys 62 around which the inside of the guide belt 61 is wound, at two ends of the guide belt 61 in the direction of extension; a motor 63 that is linked to one of the pair of pulleys 62 (the one in the front) and rotatingly drives the one pulley 62; and a pair of left and right guide rails 64 provided extending in the orthogonal direction Dp. The lower surface of the head support section 35 of the head unit 3U is attached to the guide belt 61, and is also supported by the guide rails 64 so as to be able to slide in the orthogonal direction Dp over the pair of guide rails 64.

When a command coming from a control unit 80 causes the motor 63 to operate, the guide belt 61 rotates, and, in association with the rotation of the guide belt 61, the head support section 35 moves in the orthogonal direction Dp while being supported by the pair of guide rails 64. As a result, the entirety of the head unit 3U moves in the orthogonal direction Dp. A control for moving the head unit 3U to each of the positions P1, P2, P3 may be carried out by controlling the rotational speed of the motor 63 in accordance with the distance between each of the positions, or may be carried out on the basis of a detection result of a provided position sensor able to detect the position of the head unit 3U in the orthogonal direction Dp. The print heads 36*a* to 36*e* provided to the head unit 3U are arranged so as to be located between the pair of guide rails 64 (see FIG. 1), and the guide rails 64 are unlikely to become a hindrance in a case where a worker is accessing the nozzle formation surface of the print heads 36*a* to 36*e* or the like.

Herein, the outer casing member 10 of the image recording device 1 is configured so as to allow for opening and closing in a state where the head unit 3U is accommodated therein. More specifically, as illustrated in FIG. 3, a portion of the front surface of the outer casing member 10 is configured to be an opening and closing member 11 that can rotate in the horizontal direction about a shaft 11*a*, and opening the opening and closing member 11 makes it possible to bring the outer casing member 10 into an opened state. Then, when the head unit 3U is moved to the third position P3 in the state where the outer casing member 10 is open, a part of the print head 36 is configured so as to protrude further outward than a front surface position (the position of the double-dotted dashed line in FIG. 3) of the outer casing member 10 in a state where the opening and closing member 11 is closed. According to this configuration, the head unit 3U at the third position P3 protrudes further outward than the outer casing member 10 in the closed state, and thus the outer casing member 10 can be reduced in size in comparison to a case where the head unit 3U at the third position P3 were to be entirely accommodated in the interior of the outer casing member 10. In the present embodiment, the configuration is such that a part of the print head 36 protrudes further outward than the front surface position (the position of the double-dotted dashed line in FIG. 3) of the outer casing member 10 in the state where the opening and closing member 11 is closed, but the configuration may also be such that the entirety of the print head 36 protrudes further outward than the front surface position (the position of the double-dotted dashed line in FIG. 3) of the outer casing member 10. Such a case may also be implemented by configuring so that a part of the guide rails 64 stretches further outward than the front surface position of the outer casing member 10. It would also be possible to employ another configuration for the configuration for opening and closing the outer casing member 10. For example, the configuration may be such that the front surface of the outer casing member 10 is detachable, or the configuration may be such that the front surface of the outer casing member 10 can be slid open and closed.

As illustrated in FIG. 3, an operation unit 12 for the work to issue a variety of commands to the image recording device 1 is provided to a front surface left section of the outer casing member 10; the third position is located further to the side (the front side) where the operation unit 12 is provided than the first position P1 and the second position P2 in the orthogonal direction Dp. This manner of arranging the third position P3 allows the worker to more readily access the operation unit 12 as well as the head unit 3U at the third position P3, and makes it possible to improve workability for the worker. Having the operation unit 12 and the third position P3 be both at the front side is also preferable because then, for example, it is possible, for example, to attach the rear surface of the image recording device 1 to a wall of a room, and to have a layout permitting a larger working space on the front side. The operation unit 12 need not necessarily be provided integrally with the outer casing member 10, and may be provided separately from the outer casing member 10.

In the image recording device 1 configured as above, a transition from the image recording state to the maintenance state, need only involve changing the head unit 3U from the state of being close to the platen 30 at the first position P1 to the separated state and actuating the motor 63 to move the head unit 3U from the first position P1 to the second position P2. A transition from the maintenance state to the manual task state need only involve actuating the motor 63 to move the head unit 3U from the second position P2 to the third position P3. However, the pattern for moving the head unit 3U to each of the positions P1, P2, P3 is not limited thereto, and it would also be possible to move between any two positions.

As per the foregoing, according to the present embodiment, the first position P1, the second position P2, and the third position P3 are provided to mutually different positions in the orthogonal direction Dp orthogonal to a direction in which the print head 36 and the platen 30 face each other (a relative movement direction) Df (see FIG. 4) in the image recording state. That is to say, the position of the print head 36 in the maintenance state (the second position P2) is different in the orthogonal direction Dp from both the position of the print head 36 in the image recording state (the first position P1) and the position of the print head 36 in the manual task state (the third position P3), and therefore when the print head 36 is moved to the second position P2, the print head 36 faces the maintenance unit 5 and the maintenance state can be implemented. For this reason, there is no need to considerably move the maintenance unit 5 to the position facing the print head 36 in order to switch to the maintenance state. Likewise, switching from the maintenance state to another state requires only moving the print head 36 to the first position P1 or the third position P3, and there is no need for a great deal of movement in order to withdraw the maintenance unit 5 from the position facing the print head 36. As such, a switch between the maintenance state and another state can be readily made without having to considerably move the maintenance unit 5.

Moreover, according to the present embodiment, the whole area of the print head 36 protrudes out from the platen 30 and the maintenance unit 5 in the orthogonal direction Dp when the print head 36 is at the third position P3. This manner of having the whole area of the print head 36 protrude out from the platen 30 and the maintenance unit 5 broadens the opening space OS that is ensured in the region faced by the print head 36, and allows the worker to more readily carry out the manual task. Whether or not the print head 36 should protrude out from the platen 30 or the maintenance unit 5 can be determined by, for example, whether or not the surface of the print head 36 facing the platen 30 (the nozzle formation surface) protrudes out from the platen 30 and the maintenance unit 5 in the orthogonal direction Dp.

Also, in the present embodiment, the second position P2 and the third position P3 are at positions apart from the conveyance path Pc on which the sheet S is conveyed in plan view (are outside the region between the single-dotted dashed lines in FIG. 3). According to the configuration of such description, the second position P2 and the third position P3 do not overlap with the conveyance path Pc of the sheet S in plan view, and therefore when the maintenance is being carried out at the second position P2 or when the manual task is being carried out at the third position P3, ink that has attached to the print head 36 can be prevented from dropping down or spreading toward the sheet S that is on the conveyance path Pc, and sullying the sheet S. Further, the orthogonal direction Dp is orthogonal to the conveyance direction Ds in plan view, and the first position P1, the second position P2, and the third position P3 are arranged side by side along the orthogonal direction Dp. As such, the distance for moving from the first position P1 to the second position P2 or to the third position P3 can be shortened, thus curtailing the times needed to switch to the maintenance state and needed to switch to the manual task state.

Second Embodiment

Figure 5:
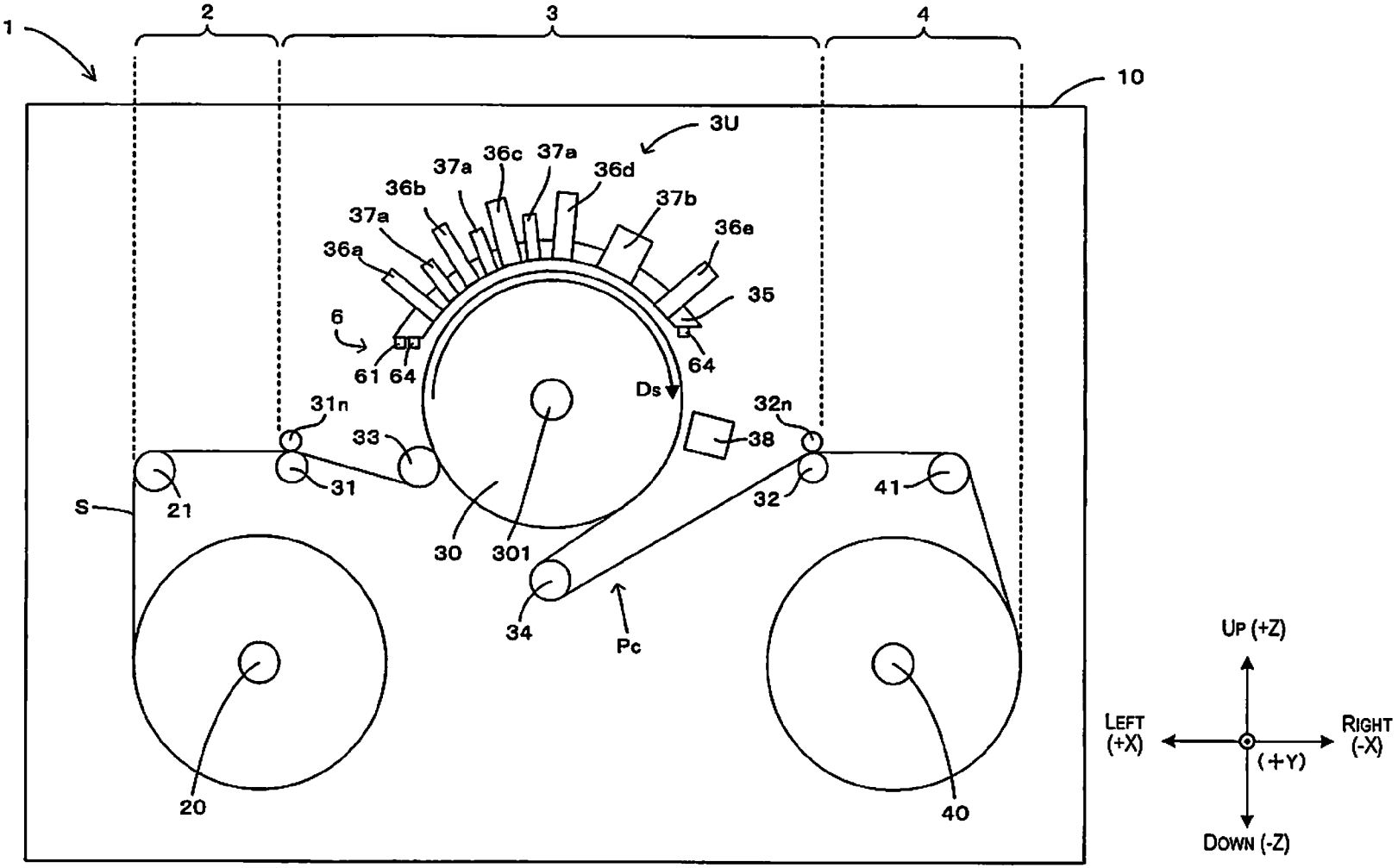
FIG. 5 is a front view schematically illustrating a second embodiment of an image recording device as in the invention.
Figure 6:
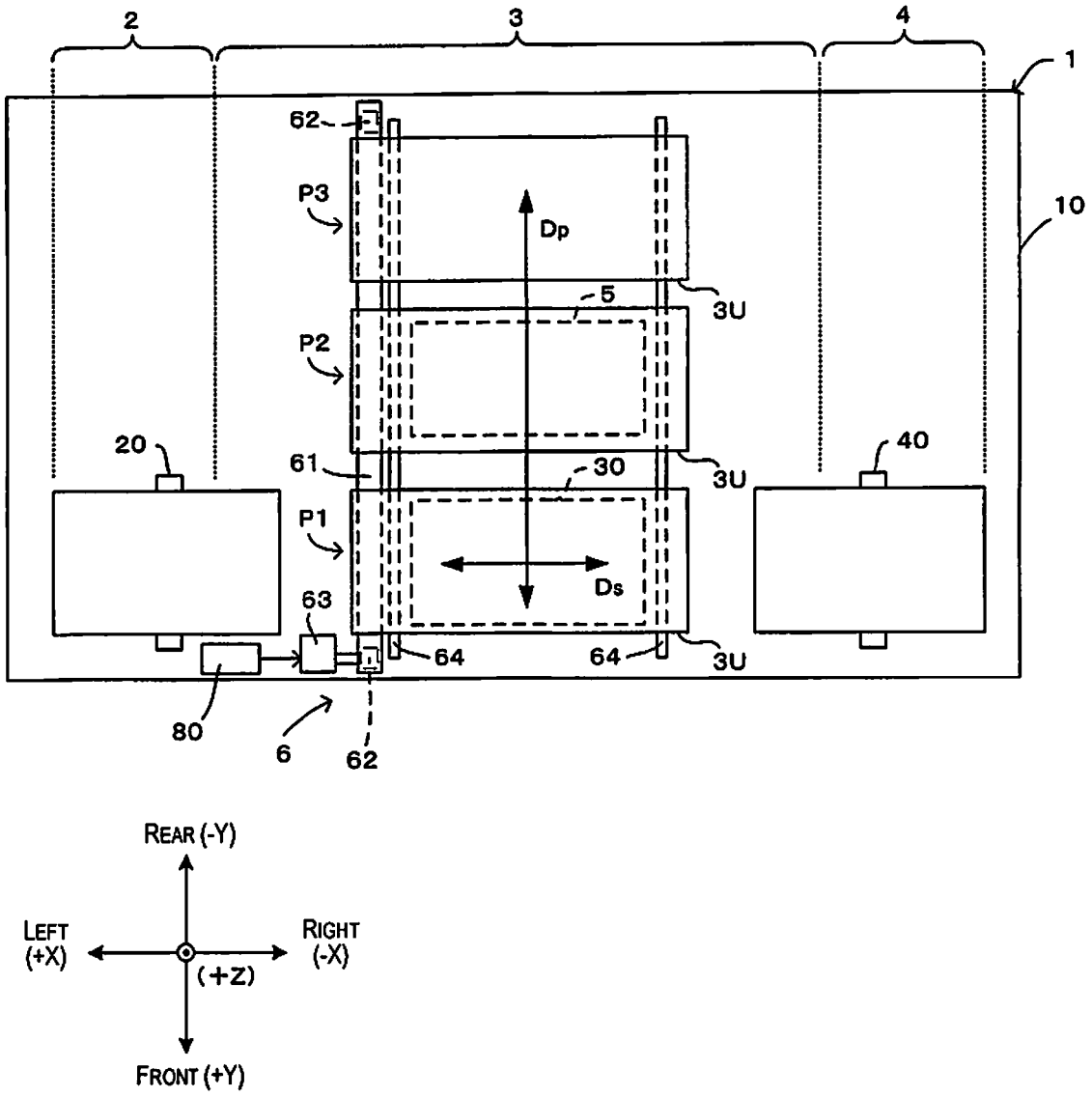
FIG. 6 is a plan view illustrating a mode of movement of a head unit in the second embodiment.
Figure 7:
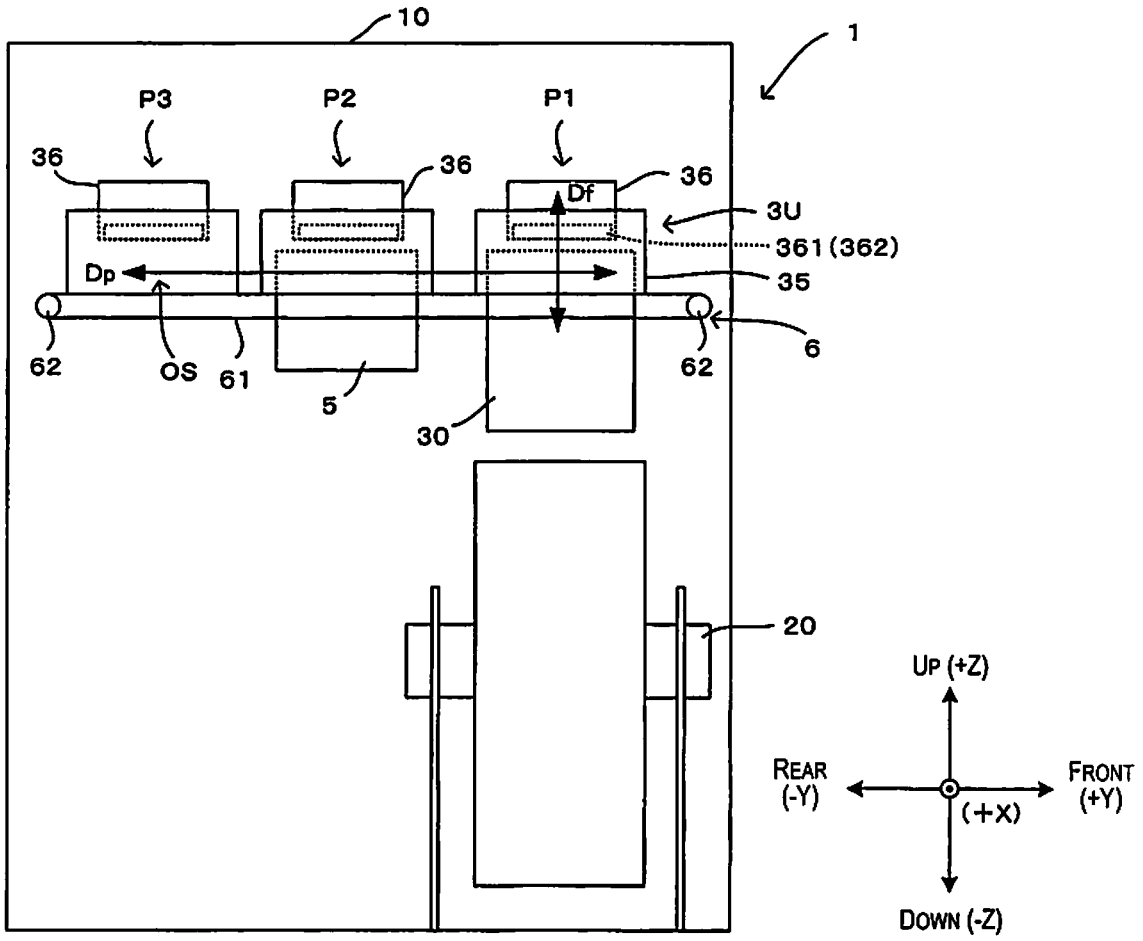
FIG. 7 is a side view illustrating a mode of movement of the head unit in the second embodiment.

A second embodiment of the image recording device as in the invention shall next be described with reference to FIGS. 5 to 7. FIG. 5 is a front view schematically illustrating the second embodiment of the image recording device as in the invention, FIG. 6 is a plan view illustrating a mode of movement of the head unit in the second embodiment, and FIG. 7 is a side view illustrating a mode of movement of the head unit in the second embodiment. The second embodiment mainly differs from the first embodiment with respect to the shape of the platen 30 and the mode of movement of the head unit 3U, but is similar to the first embodiment with respect to other basic device configurations and operations. As such, a description for portions in common with the first embodiment is omitted. It shall be readily understood that by being provided with configurations in common with the first embodiment, the second embodiment also achieves effects similar to those of the first embodiment.

As illustrated in FIG. 5, in the second embodiment, the platen 30 provided to the process section 3 is a rotating drum, which is a type of drum that has a cylindrical shape. More specifically, the platen 30 is supported by a support mechanism (not shown) so as to freely rotate about a rotating shaft 301 extending in the front-back direction (Y-direction), and the sheet S being conveyed from the front drive roller 31 toward the rear drive roller 32 is wound therearound from the back surface side. The platen 30 is intended to support the sheet S from the back surface side while also being driven to rotate in the conveyance direction Ds of the sheet S, under the force of friction against the sheet S. Also provided are the driven rollers 33, 34 at which the sheet S is looped back at both sides of the section wound around the platen 30. Of these, the driven roller 33 loops the sheet S around with the surface of the sheet S wound therearound between the front drive roller 31 and the platen 30. In turn, the driven roller 34 loops the sheet S around with the surface of the sheet S wound therearound between the platen 30 and the rear drive roller 32. In this manner, the sheet S is looped around upstream and downstream of the platen 30 in the conveyance direction Ds, whereby the length of the section of the sheet S wound around the platen 30 can be ensured. Thus, the sheet S being conveyed from the front drive roller 31 toward the rear drive roller 32 is conveyed in the conveyance direction Ds over the platen 30 while being supported by the outer peripheral surface of the platen 30.

In association with the platen 30 being a drum, the print heads 36*a* to 36*e* and the UV lamps 37*a*, 37*b* are arrayed on an arc along the outer peripheral surface of the platen 30. The print heads 36*a* to 36*e* and the UV lamps 37*a*, 37*b*, which are supported by the head support section 35, thus are integrated to constitute the head unit 3U. The head support section 35 is able to slide along the axial direction (Y-direction) of the rotating shaft 301 of the platen 30, over the pair of left and right guide rails 64 of the guide mechanism 6, and when the head support section 35 moves in the axial direction, the entirety of the head unit 3U moves in the axial direction. This manner of support, by the head support section 35, of the print heads 36*a* to 36*e* and UV lamps 37*a*, 37*b* arranged side by side along the arcuate outer peripheral surface of the platen 30, and of movement of the head support section 35 along the axial direction of the drum-type platen 30, makes it possible to move the head unit 3U while minimizing interference between the head unit 3U and the platen 30.

As illustrated in FIGS. 6 and 7, the present embodiment is similar to the first embodiment in the first position P1, the second position P2, and the third position P3 are arranged along the orthogonal direction Dp (front-back direction) orthogonal to the conveyance direction Ds of the sheet S in plan view, but is unlike the first embodiment in that the third position P3 is arranged to the rear of the second position P2. That is to say, in the present embodiment, the first position P1 facing the platen 30 arranged near the front middle section of the image recording device 1, the second position P2 facing the maintenance unit 5 disposed to the rear of the platen 30, and the third position P3 located even more to the rear than the second position P2 are arranged side by side in the stated order along the orthogonal direction Dp. When the head unit 3U is at the third position P3, the whole area of the print head 36 protrudes out from the maintenance unit 5 in the orthogonal direction Dp, which is the direction going from the platen 30 toward the maintenance unit 5. That is to say, the front end of the print head 36 when at the third position P3 is located further to the rear than the rear end of the maintenance unit 5, and the whole area of the print head 36 faces neither the platen 30 nor the maintenance unit 5 in the orthogonal direction Dp, and therefore a broad opening space OS (see FIG. 7) is ensured below the whole area of the print head 36 in the orthogonal direction Dp, thus entering the manual task state in which the worker can access the print head 36 and carry out the manual task from the opening space OS.

When the first position P1, the second position P2, and the third position P3 are thus configured to be arranged side by side in the stated order along the orthogonal direction Dp, this is preferable for a case where the manual task by the worker is carried out after the maintenance by the maintenance unit 5 has been completed. That is to say, in such a case it is necessary to move the print head 36 from the second position P2 to the third position P3, but according to the above configuration, the print head 36 can be moved from the second position P2 to the third position P3 without having to pass through the first position P1. As such, dropping or spreading of liquid that has attached to the print head 36, onto the platen 30 or the sheet S that is on the platen 30, at the first position P1 can be avoided.

Other Embodiments

The invention is not limited to the above embodiments, and the elements of the embodiments described above can be combined or variously modified as appropriate without departing from the essence of the invention. For example, the above embodiments have the maintenance unit 5 arranged to the rear of the platen 30, but this relative positional relationship is not limited thereto. Also, the first embodiment had the third position P3, the first position P1, and the second position P2 arranged side by side in the stated order going from the front to the rear of the image recording device 1, and the second embodiment had the first position P1, the second position P2, and the third position P3 arranged side by side in the stated order going from the front to the rear of the image recording device 1. However, other orderings of the first position P1, the second position P2, and the third position P3 can be adopted as well.

Also, in the above embodiments, the platen 30 and the maintenance unit 5 are arranged at different positions in the orthogonal direction Dp orthogonal to the conveyance direction Ds in plan view. However, the platen 30 and the maintenance unit 5 need only be arranged at different positions in a direction orthogonal to the direction Df in which the print head 36 and the platen 30 face each other in the image recording state, and need not be arranged at different positions in the orthogonal direction Dp orthogonal to the conveyance direction Ds in plan view. For example, the arrangement may be at different positions in the conveyance direction Ds. Also, the above embodiments had the first position P1, the second position P2, and the third position P3 arranged side by side along the orthogonal direction Dp, but the arrangement of each of the positions P1, P2, and P3 is not limited thereto. That is to say, the first position P1, the second position P2, and the third position P2 may be arranged side by side along a direction other than the orthogonal direction Dp, and the first position P1, the second position P2, and the third position P3 need not necessarily be arranged side by side along a single line.

Additionally, the above embodiments had the whole area of the print head 36 protruding out from the platen 30 and the maintenance unit 5 when the print head 36 is at the third position P3, but the configuration may be such that only part of the print head 36 protrudes out from the platen 30 and the maintenance unit 5 in the orthogonal direction Dp. For example, the task of manually wiping the periphery of the nozzles 361 would become possible when the region of the print head 36 in which the nozzles 361 are formed in the orthogonal direction Dp (a formation region of the nozzle columns 362) is made to protrude out from the platen 30 and the maintenance unit 5. The task of manually wiping the suction port 381 also would become possible when the region of the print head 36 to which the suction port 381 of the mist suction section 38 is provided in the orthogonal direction Dp is made to protrude out from the platen 30 and the maintenance unit 5. In summary, the extent to which the print head 36 should protrude out can be freely selected as appropriate depending on the type of manual task.

Furthermore, the above embodiments had the plurality of print heads 36 integrally configured as a single head unit 3U, where moving the head unit 3U to each of the positions P1, P2, P3 causes each of the print heads 36 to be located at each of the positions P1, P2, P3 and makes it possible to switch to the image recording state, the maintenance state, and the manual task state. However, positioning each of the print heads 36 at each of the positions P1, P2, P3 by moving the single head unit 3U to each of the positions P1, P2, P3 is not an essential requirement for the invention. For example, the configuration may be one where a plurality of head units 3U are provided and the print heads 36 are provided to each of the head units 3U, or the configuration may be one where no head unit 3U is provided, and each of the print heads 36 is moved directly to each of the positions P1, P2, P3.

The above embodiments also had the guide mechanism 6 be a belt drive mechanism using the guide belt 61 and the motor 63, with the movement of the head unit 3U being controlled by the control unit 80. However, the guide mechanism 6 may employ another configuration; for example, the guide mechanism 6 may be constituted of a ball-screw mechanism or the like. A drive mechanism also need not necessarily be provided; the worker may manually move the head unit 3U to each of the positions P1, P2, P3 along the guide rails 64.

The above embodiments were configured so that when the head unit 3U is at the first position P1, a switch can be made between the near state where the head unit 3U is brought near to the platen 30 and an image is recorded, and the separated state where the gap between the head unit 3U and the platen 30 is increased and contact during movement can be minimized. However, configuring so that the head unit 3U adopts the near state and the separated state when at the first position P1 is not an essential requirement for the invention.

An image recording device as in the embodiment includes a support member for supporting a recording medium being conveyed in a conveyance direction, a print head for ejecting a liquid from a nozzle at a first position facing the support member, to record an image on the recording medium that is on the support member; a maintenance unit for carrying out a first maintenance on the print head, the maintenance unit being arranged at a position different from that of the support member in an orthogonal direction orthogonal to the facing direction in which the print head at the first position and the support member face each other; and a guide mechanism for guiding movement of the print head between the first position, a second position at which the print head faces the maintenance unit and receives the first maintenance, and a third position which is a position different from those of the support member and the maintenance unit in the orthogonal direction, a space by which a second maintenance by manual task can be performed on the print head, at a position facing the print head, being present when the print head is at the third position.

In the embodiment thus configured (the image recording device), the print head records an image onto the recording medium at the first position facing the support member for supporting the recording medium (an image recording state). The maintenance unit is arranged at a position different from that of the support member in the orthogonal direction orthogonal to the facing direction in which the print head at the first position and the support member face each other, which is to say that the maintenance unit is arranged spaced apart in the orthogonal direction from the region faced by the print head in the image recording state. Then, moving the print head to the second position facing the maintenance unit arranged spaced apart in the orthogonal direction from the support member in this manner causes the print head to face the maintenance unit, thus entering a state where the first maintenance by the maintenance unit can be implemented (a maintenance state). The print head can also be moved to the third position, which is a position different from those of the support member and the maintenance unit in the orthogonal direction. Then, when the print head is at the third position, a space (opening space) by which a manual task can be performed on the print head exists in the region faced by the print head, thus entering a state where the second maintenance by a worker can be performed on the print head through the opening space (a manual task state).

As above, according to the embodiment, the first position, the third position, and the third position are provided to positions that are different in the orthogonal direction orthogonal to the direction in which the print head and the support member face each other in the image recording state. That is to say, the position of the print head in the maintenance state (the second position) is different in the orthogonal direction from both the position of the print head in the image recording state (the first position) and the position of the print head in the manual task state (the third position), and therefore when the print head is moved to the second position, the print head faces the maintenance unit and the maintenance state can be implemented. For this reason, there is no need to considerably move the maintenance unit to the position facing the print head in order to switch to the maintenance state. Likewise, switching from the maintenance state to another state requires only moving the print head to the first position or the third position, and there is no need for a great deal of movement in order to withdraw the maintenance unit from the position facing the print head. As such, a switch between the maintenance state and another state can be readily made without having to considerably move the maintenance unit.

Herein, preferably, when the print head is at the third position, the full area of the print head protrudes out from the support member in an orthogonal direction going from the maintenance unit toward the support member, or, the full area of the print head protrudes out from the maintenance unit in an orthogonal direction going from the support member toward the maintenance unit. This manner of having the full area of the print head protrude out from the support member and the maintenance unit broads the opening space ensured in the region faced by the print head, and allows for the worker to more readily carry out the manual task.

Preferably, the second position and the third position are positions separated apart from a conveyance path on which the recording medium is conveyed in plan view. According to the configuration of such description, the second position and the third position do not overlap with the conveyance path of the recording medium in plan view, and therefore when the maintenance is being carried out at the second position or when the manual task is being carried out at the third position, ink that has attached to the print head can be prevented from dropping down or spreading toward the recording medium that is on the conveyance path, and sullying the recording medium.

Also preferable are instances such as the following when the first position, the second position, and the third position are configured arranged side by side in the stated order along the orthogonal direction. One example would be a case where liquid that has attached to the print head is wiped off by a manual task after the maintenance by the maintenance unit has been completed. In such a case it is necessary to move the print head from the second position to the third position, but according to the above configuration, the print head can be moved from the second position to the third position without having to pass through the first position. As such, dropping or spreading of liquid that has attached to the print head, onto the support member or the recording medium that is on the support member, at the first position can be avoided.

The configuration could also possibly be further provided with an outer casing member that can open and close in a state where the print head is accommodated, the print head protruding further outward than the outer casing member in the closed state when the print head is at positioned at the third position in the state where the outer casing member is open. According to this configuration, the print head at the third position protrudes further outward than the outer casing member in the closed state, and thus the outer casing member can be reduced in size in comparison to a case where the head unit at the third position were to be entirely accommodated in the interior of the outer casing member.

Also preferably, the image recording device is further provided with an operation unit by which the worker issues a variety of commands, the third position being positioned closer to a side to which the operation unit is provided in relation to the first position and the second position. When the third position is positioned closer to the side to which the operation unit is provided in this manner, the worker more readily accesses both the operation unit and the print head that is at the third position, thus improving workability for the worker.

Also preferable is a configuration such that the image recording device is further provided with a head support section for supporting a plurality of print heads disposed along the conveyance direction, the plurality of print heads moving along with the head support section when the head support section moves. In some instances, a plurality of print heads are provided, such as where color printing is being carried out, but according to a configuration where the plurality of print heads move along with the head support section in such a case, all of the print heads can be moved at once by moving the head support section, thus facilitating switching to the variety of states.

The configuration may be such that the support member is a rotating drum that has a cylindrical shape and that has a rotating shaft that extends in the orthogonal direction, the plurality of print heads being arranged side by side in an arc shape along an outer peripheral surface of the rotating drum and supported by the head support section, and the guide mechanism guiding the movement of the head support section along the orthogonal direction. When the plurality of print heads are arrayed in an arc shape so as to run along the outer peripheral surface of the cylindrical rotating drum, interference is prone to take place between the print heads and the rotating drum when the print heads are moved. Therefore, as per the above configuration, having the direction in which the rotating shaft of the rotating drum extends and the direction of movement of the head support section for supporting the plurality of print heads both run along the orthogonal direction makes it possible to minimize any interference between the print head and the rotating drum.

What is claimed is:

1. An image recording device comprising:

a support member configured to support a recording medium being conveyed in a conveyance direction;

a print head configured to eject a liquid from a nozzle at a first position facing the support member so as to record an image on the recording medium which is located on the support member;

a guide mechanism configured to guide movement of the print head among the first position, a second position which is different from the first position, and a third position which is different from the first position and the second position in an orthogonal direction orthogonal to a facing direction in which the print head at the first position and the support member face each other; and a maintenance unit configured to carry out maintenance on the print head which is located at the second position, the maintenance unit being arranged at a position facing the print head which is located at the second position, the third position being a position farther than the second position with respect to the first position in a direction going from the support member toward the maintenance unit in the orthogonal direction.

2. The image recording device as set forth in claim 1, wherein when the print head is at the third position, the full area of the print head protrudes out from the maintenance unit in a direction going from the support member toward the maintenance unit in the orthogonal direction.

3. The image recording device as set forth in claim 1, wherein the second position and the third position are positions separated apart from a conveyance path on which the recording medium is conveyed in a plan view.

4. The image recording device as set forth in claim 1, wherein the first position, the second position, and the third position are arranged in this order along the orthogonal direction.

5. The image recording device as set forth in claim 1, further comprising:

an outer casing member which can open and close in a state where the print head is accommodated, wherein the print head protrudes further outward than the outer casing member in a closed state when the print head is positioned at the third position in a state where the outer casing member is open.

6. The image recording device as set forth in claim 1, further comprising:

a head support section configured to support a plurality of print heads disposed along the conveyance direction, wherein the guide mechanism guides movement of the head support section among the first position, the second position, and the third position in the orthogonal direction.

7. The image recording device as set forth in claim 6, wherein the support member is a rotating drum which has a cylindrical shape and is provided with a rotating shaft extending in the orthogonal direction, the plurality of print heads being arranged in an arc shape along an outer peripheral surface of the rotating drum and supported by the head support section.

8. An image recording device, comprising:

a support member configured to support a recording medium being conveyed in a conveyance direction;

a print head configured to eject a liquid from a nozzle at a first position facing the support member so as to record an image on the recording medium which is located on the support member;

a guide mechanism configured to guide movement of the print head among the first position, a second position which is different from the first position, and a third position which is different from the first position and the second position in an orthogonal direction orthogonal to a facing direction in which the print head at the first position and the support member face each other; and a maintenance unit configured to carry out maintenance on the print head which is located at the second position, the maintenance unit being arranged at a position facing the print head which is located at the second position, the first position, the second position, and the third position being arranged in an order of the third position, the first position, and the second position along the orthogonal direction.

9. The image recording device as set forth in claim 8, wherein when the print head is at the third position, the full area of the print head protrudes out from the support member in a direction going from maintenance unit the toward support member in the orthogonal direction.

10. The image recording device as set forth in claim 8, wherein the second position and the third position are positions separated apart from a conveyance path on which the recording medium is conveyed in a plan view.

11. The image recording device as set forth in claim 8, further comprising:

an outer casing member which can open and close in a state where the print head is accommodated, wherein the print head protrudes further outward than the outer casing member in a closed state when the print head is positioned at the third position in a state where the outer casing member is open.

12. The image recording device as set forth in claim 8, further comprising:

an operation unit by which the worker issues a variety of commands, the operating unit being disposed on a side of the third position out of the second position and the third position which are located with the first position being located therebetween.

13. The image recording device as set forth in claim 8, further comprising:

a head support section configured to support a plurality of print heads disposed along the conveyance direction, wherein the guide mechanism guides movement of the head support section among the first position, the second position, and the third position in the orthogonal direction.

14. The image recording device as set forth in claim 13, wherein the support member is a rotating drum which has a cylindrical shape and is provided with a rotating shaft extending in the orthogonal direction, the plurality of print heads being arranged in an arc shape along an outer peripheral surface of the rotating drum and supported by the head support section.

* * * * *